United States Patent [19]

Röck

[11] Patent Number: 4,961,648

[45] Date of Patent: Oct. 9, 1990

[54] PULL-OUT GUIDE ASSEMBLY FOR DRAWERS OR THE LIKE

[75] Inventor: Erich Röck, Höchst, Austria

[73] Assignee: Julius Blum Gesellschaft m.b.H., Höchst, Austria

[21] Appl. No.: 477,765

[22] Filed: Feb. 9, 1990

[30] Foreign Application Priority Data

Feb. 22, 1989 [AT] Austria ..... A 400/89

[51] Int. Cl.[5] ..... F16C 29/00

[52] U.S. Cl. ..... 384/19; 384/21; 384/22

[58] Field of Search ..... 384/19, 21, 22, 18, 384/58, 57; 312/332

[56] References Cited

U.S. PATENT DOCUMENTS 3,142,517 7/1964 Ward ..... 384/21

4,601,522 7/1986 Röck ..... 384/19

4,692,035 9/1987 Röck et al. ..... 384/21

4,741,628 5/1988 Kinley ..... 384/22

*Primary Examiner*—Lenard A. Footland

*Attorney, Agent, or Firm*—Wenderoth, Lind & Ponack

[57] ABSTRACT

A pull-out guide assembly for a drawer or the like includes a pull-out rail on each side of the drawer and a supporting rail on each side of a furniture body, as well as load-transmitting rollers. Each supporting rails is in the longitudinal direction, divided into a stop member fastenable to a furniture side wall and a running member. The running members are pivotally mounted on the stop members about vertical axle located in the centers of respective running members. The running member of at least one supporting rail is acted upon by at least one spring which holds such running member parallel to the furniture side wall.

11 Claims, 2 Drawing Sheets

PULL-OUT GUIDE ASSEMBLY FOR DRAWERS OR THE LIKE

FIELD AND BACKGROUND OF THE INVENTION

The invention relates to a pull-out guide assembly for a drawer or the like, comprising a pull-out rail on each side of the drawer and a supporting rail on each side of a furniture body and load-transmitting slides or rollers which are mounted in a carriage on both sides of the drawer. In the longitudinal direction each supporting rail is divided into a stop member fastenable to a furniture side wall and a running member, and the running members being pivotally mounted on the stop members about vertical axles and acted upon by springs.

Pull-out guide assemblies of the afore-mentioned kind make extraction and insertion of the drawer into a furniture body as smooth as possible, and they hold the drawer in the furniture body when it has been partly extracted therefrom, in particular when the drawer has been pulled out from the furniture body over more than half its depth.

According to the known state of the art, pull-out guide assemblies of this kind are provided either with slides or rollers. Pull-out guide assemblies are also known in which the rollers are mounted in separate carriages.

A pull-out guide assembly for drawers is known from U.S. Pat. No. 526,509 in which the running members are pivotable about front verticle axles. The rear ends of the running members are acted upon by springs and pressed towards the drawer. In this arrangement, the drawer is practically clamped by the running members, and thus the friction between the drawer and the running members increases the further the drawer is pushed into the furniture body. When the drawer tilts sideways, its position will be corrected at least in the pushed-in position.

It may occur that a drawer which has been partly extracted from the furniture body remains in the extracted position. In particular in the case of sharp corners and edges, which are frequently found with drawer front plates, persons may bump against such projecting drawers and get injured to a varying degree. Furthermore, the drawer and/or the pull-out guide assembly might be damaged.

Pull-out guide assemblies with so-called run-in means are known in which a drawer which has been closed without care is automatically pulled into the furniture body.

Pull-out guide assemblies of this kind are not able, however, to fully solve the problem solved by the present invention since the run-in means become effective only in the final region of the push-in path of the drawer, which means the drawer has to be pushed at least substantially into its rear position to be drawn into the furniture body by the run-in means. In the case of a drawer which projects more than half of its depth from the furniture body, the run-in means generally remain ineffective. Particularly in the case of drawers projecting in this manner, the risk of injury is high.

SUMMARY OF THE INVENTION

It is the object of the invention to provide an improved pull-out guide of the kind mentioned above, wherein injuries caused by a drawer projecting from a furniture body or damage caused to such a drawer by persons bumping against it are largely prevented or reduced.

According to the invention this is achieved in that the running members are guided parallel to each other and are pivotable together in the same direction.

Advantageously, a pivot axle is located substantially in the center of each running member so that the running members are able to swing at the front and at the rear ends thereof to the same degree in opposite directions.

A preferred embodiment of the invention provides that the running members are urges to positions parallel to the furniture side walls by at least one spring.

Instead of one or several springs of the afore-mentioned kind, buffers may also be fastened to the running members or to the furniture side walls. The embodiment with the spring has, however, proved particularly advantageous since in this arrangement the displaced drawer is automatically brought again into its running position, that is aligned parallel to the drawer side walls.

Advantageously, the stop members are longitudinal and preferably of the same length as the running members. To obtain better guiding of the running members, they are, in a preferred embodiment, each provided with two bolts or the like which extend into slots converging in the direction to the furniture side wall, the bolts and the slots being arranged in the four corners of a rectangle. During pivotal movement of the running members, the bolts obviously describe circular arcs. Since the path covered by the bolts is very short, the slots need not be arcuate, they can also be rectilinear. It is advantageously provided that at least one running member is acted on at each of its two ends by one spring at each such end.

To align the running members and thus the drawer exactly in the center, a further embodiment of the invention provides that each spring presses on two levers of a pincer having jaws or lugs which embrace the running member as well as the stop member in a clamping arrangement.

Advantageously each stop member and respective running member overlap each other and are provided with recesses into which lugs or jaws of the pincers extend.

To guarantee that a drawer which has been displaced by a bump is returned into its initial position by the springs and that no clamping occurs, a friction reducing layer may be arranged between each stop members and the respective running member. Either one of the flanges of the running member or of the stop member may be provided with a Teflon coating, or a plastics sheet may be arranged between the stop member and the running member.

It is advantageously provided that the axle is arranged at the side of the running path or paths of the rollers or slides which is remote from the furniture side wall.

Particularly good guiding of each running member is obtained when the axle and the bolts and slots are arranged at opposite sides of the running path or track.

BRIEF DESCRIPTION OF THE DRAWINGS

In the following an embodiment of the invention will be described in more detail with reference to the accompanying drawings in which.

DETAILED DESCRIPTION OF THE INVENTION

Figure 1:
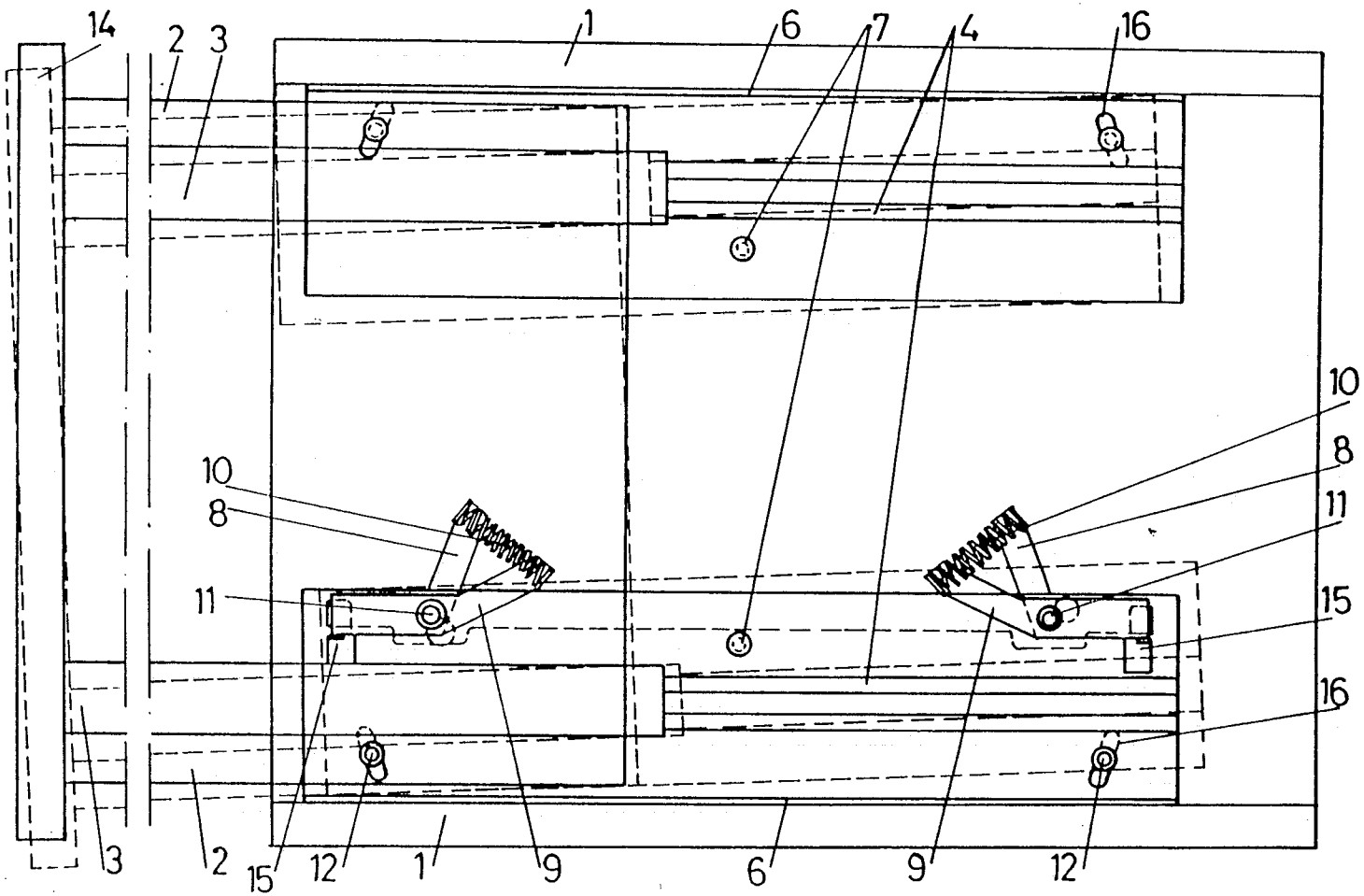
FIG. 1 is a diagrammatic top view of a drawer with a pull-out guide assembly according to the invention.

In the drawings, two side walls of a drawer are designated with reference number 2 and a drawer bottom with reference number 13. The side walls of a furniture body are designated with reference number 1. Underneath the drawer bottom 13, a pull-out rail 3 is fastened to each side of the drawer, that is inwardly with respect to the drawer side walls 2.

Figure 2:
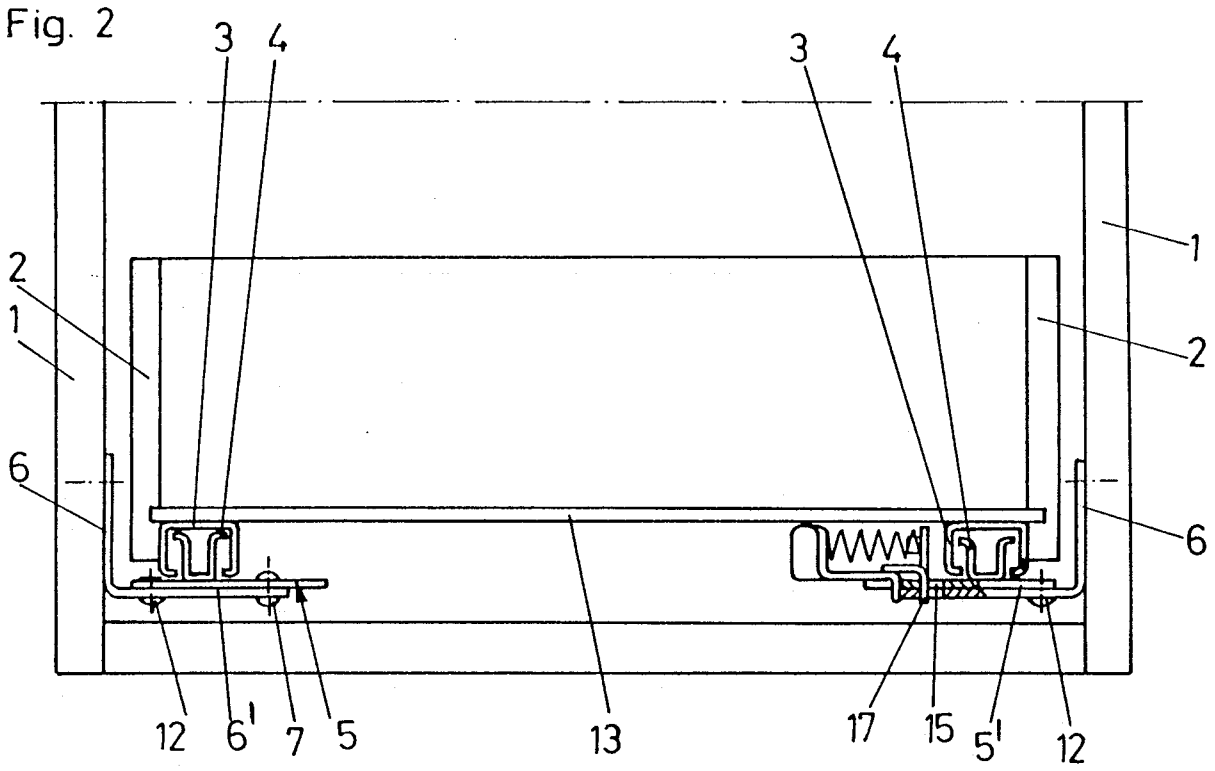
FIG. 2 is a cross-sectional view of a drawer and a furniture body with a pull-out guide assembly according to the invention.

Each supporting rail includes a stop member 6 having an angular shape, as can be seen from FIG. 2, and fastened to a respective side wall 1 of the furniture body, and preferably screwed to the side wall 1. Each supporting rail also includes a running member 5 mounted on a horizontal flange 6' of the respective stop member 6. The running member 5 has a horizontal flange 5' and a U-shaped member with lateral marginal flanges forming a running path or track 4.

Depending on the requirements, rollers or slides are mounted between the stop member 6 and the pull-out rail 3. They are not shown in the drawings since the actual running system is not the subject of the present invention.

As can be seen from the drawings, the running members 5 are pivotally mounted on the stop members 6 by means of axles 7 which are formed by rivets, for example. The axles 7 are located substantially in the center of the running members 5 and of the stop members 6 which are also rail-like. As can particularly be seen in FIG. 1, each axle 7 is arranged at the inner side of the respective U-shaped member, that is of the respective running path 4 of the running member 5, as well as of the respective pull-out rail 3.

At the outer side of each running member 5, that is adjacent the respective body side wall 1, each stop member 6 is provided with bolts 12. Such bolts 12 extend in this arrangement vertically through slots 16 which are arranged in the horizontal flanges 5' of the running members 5. The slots 16 in each flange 5' converge towards the respective furniture side wall 1 and form together with the bolts 12 a guiding for the respective running member 5.

On one side of the drawer two pincers, each of which is formed by two levers 8,9 are mounted on axles 11 at the two ends of the respective running member 5. The levers 8,9 are pressed apart by a spring 10 which is a coil spring in this embodiment.

Thus running members 5 and the respective stop member 6 have recesses 15 through which lugs or jaws 17 of the pincers which are formed by the levers 8,9 extend. A second lug or jaw 17 of each pincer presses laterally against the horizontal flanges 5',6' of the running member 5 and of the stop member 6.

When the drawer is laterally tilted, for example by something bumping against a drawer front plate 14, the pull-out rails 3 and the running members 5 are brought into the position shown in FIG. 1 by dotted lines. The levers 8,9 are pressed apart at their rail-side ends against the pressure of the springs 10. When the force laterally acting on the drawer decreases or is eliminated, the springs 10 press the lugs 17 of the levers 8,9 together again, and the running members 5 as well as the pull-out rails 3 and thus the complete drawer are returned to the center position, that is, aligned parallel to the side walls 1 of the furniture body.

What is claimed is:

1. A pull-out guide assembly for a drawer and comprising, on each side of the drawer:

a pull-out rail on the side of the drawer and a supporting rail on the side of a furniture body and load-transmitting rollers or slides, in the longitudinal direction each said supporting rail being divided into a stop member fastenable to a furniture side wall and a running member, and said running members being pivotally mounted on respective said stop members about respective vertical axles and acted upon by a spring, wherein said running members are guided parallel to each other and pivotable together in the same direction.

2. A pull-out guide assembly as claimed in claim 1, wherein said axles on which said running members are mounted are located substantially in the centers of said running members.

3. A pull-out guide assembly as claimed in claim 1, wherein said running members are held by said spring parallel to the furniture side walls.

4. A pull-out guide assembly as claimed in claim 1, wherein said stop members are longitudinal and preferably substantially of the same length as said running members.

5. A pull-out guide assembly as claimed in claim 4, wherein each said stop member has two bolts or the like which extend into slots arranged in the respective said running member and converging in the direction to the furniture side wall, said bolts and said slots being located in the four corners of a rectangle.

6. A pull-out guide assembly as claimed in claim 1, wherein at least one of said running members is acted on at each of its two ends by one spring located at each said end.

7. A pull-out guide assembly as claimed in claim 1, wherein said spring presses on two levers of a pincer having jaws which embrace said running member as well as said stop member in a clamping arrangement.

8. A pull-out guide assembly as claimed in claim 7, wherein each said stop member and respective said running member overlap each other and have recesses into which extends one jaw of said pincer.

9. A pull-out guide assembly as claimed in claim 1, wherein a friction reducing layer, for example a Teflon coating or sheet, is provided between said stop member and said running member.

10. A pull-out guide assembly as claimed in claim 1, wherein each said axle is arranged at the side of the running path or paths for the rollers or slides which is remote from the furniture side wall.

11. A pull-out guide assembly as claimed in claim 5, wherein said axle and said bolts and slots are arranged at opposite sides of the running path for the rollers or slides.

* * * * *